US009752491B2

(12) United States Patent
Powell

(10) Patent No.: US 9,752,491 B2
(45) Date of Patent: Sep. 5, 2017

(54) POWERED AIR RAM WITH ENERGY RECOVERY

(71) Applicant: DENSO International America, Inc., Southfield, MI (US)

(72) Inventor: Patrick Powell, Farmington Hills, MI (US)

(73) Assignee: Denso International America, Inc., Southfield, MI (US)

( * ) Notice: Subject to any disclaimer, the term of this patent is extended or adjusted under 35 U.S.C. 154(b) by 274 days.

(21) Appl. No.: 14/047,683

(22) Filed: Oct. 7, 2013

(65) Prior Publication Data

US 2015/0096716 A1 Apr. 9, 2015

(51) Int. Cl.
*F01P 3/18* (2006.01)
*F01P 11/10* (2006.01)

(52) U.S. Cl.
CPC ..... *F01P 3/18* (2013.01); *F01P 11/10* (2013.01); *F01P 2003/187* (2013.01)

(58) Field of Classification Search
CPC ..... B60K 11/04; F28D 2021/0091; F28D 2021/0094; F01P 3/04; F01P 3/18; F01P 2003/182; F01P 2003/187
USPC ..... 165/41, 42, 44, 51, 52, 154–156, 164, 165/185
See application file for complete search history.

(56) References Cited

U.S. PATENT DOCUMENTS 2,913,065 A * 11/1959 Lyon, Jr. ..... B60K 11/04 123/41.06
3,203,499 A * 8/1965 Bentz ..... B60K 11/04 123/41.12
3,715,001 A * 2/1973 Wilson ..... B60K 11/02 180/68.4
3,827,523 A 8/1974 Williams
4,186,817 A * 2/1980 Bauer ..... B60K 11/08 165/44
4,362,208 A * 12/1982 Hauser ..... B60K 11/04 123/41.49
4,487,034 A 12/1984 Cronin et al.
4,762,170 A 8/1988 Nijjer et al.
4,779,577 A 10/1988 Ritter et al.
4,846,258 A 7/1989 Charles
4,918,923 A 4/1990 Woollenweber et al.
(Continued)

FOREIGN PATENT DOCUMENTS

FR 2943586 10/2010
WO WO2008129190 10/2008
(Continued)

OTHER PUBLICATIONS

English translation of CN 101522909 A.*
Tom Lish, Vacuum Pressure: What is it & how do you measure it, Oct. 2015.*

*Primary Examiner* — Etsub Berhanu
*Assistant Examiner* — Nelson Nieves
(74) *Attorney, Agent, or Firm* — Harness, Dickey & Pierce, P.L.C.

(57) ABSTRACT

A cooling system including a heat exchanger, an airflow containment unit, and an airflow conduit. The airflow containment unit is configured to direct airflow to and from the heat exchanger. The airflow conduit is in fluid communication with the airflow containment unit and is configured to direct airflow to the airflow containment unit from an air inlet at an exterior of the vehicle.

23 Claims, 9 Drawing Sheets

(56) References Cited

U.S. PATENT DOCUMENTS

| | | | | |
|---|---|---|---|---|
| 5,046,554 | A * | 9/1991 | Iwasaki | B60K 11/04 123/41.49 |
| 5,588,482 | A | 12/1996 | Holka | |
| 6,302,228 | B1 * | 10/2001 | Cottereau | B60K 11/08 180/68.1 |
| 6,373,146 | B2 | 4/2002 | Horikoshi et al. | |
| 6,390,217 | B1 * | 5/2002 | O'Brien | B60K 11/04 160/DIG. 1 |
| 6,928,832 | B2 | 8/2005 | Lents et al. | |
| 7,008,175 | B2 * | 3/2006 | Fathi | F01D 1/06 415/177 |
| 7,322,202 | B2 | 1/2008 | Zywiak et al. | |
| 7,451,844 | B2 * | 11/2008 | Kunikata | B60K 11/04 180/68.1 |
| 8,708,075 | B2 * | 4/2014 | Maurer | B60K 11/08 180/68.1 |
| 2002/0153178 | A1 | 10/2002 | Limonius | |
| 2003/0070800 | A1 * | 4/2003 | Ito | B60H 1/00778 165/44 |
| 2012/0241128 | A1 * | 9/2012 | Vacca | B60K 11/04 165/44 |
| 2013/0081888 | A1 * | 4/2013 | Charnesky | B60K 11/04 180/68.3 |
| 2013/0248141 | A1 * | 9/2013 | Maurer | B60K 11/08 165/44 |

FOREIGN PATENT DOCUMENTS

| | | | |
|---|---|---|---|
| WO | CN 101522909 A | * | 9/2009 |
| WO | WO2009134186 | | 11/2009 |

* cited by examiner

POWERED AIR RAM WITH ENERGY RECOVERY

FIELD

The present disclosure relates to a powered air ram.

BACKGROUND

This section provides background information related to the present disclosure, which is not necessarily prior art.

A heat exchanger, such as a radiator, is often used to cool an engine, such as a vehicle engine. To cool the engine, coolant is pumped through the engine, where it absorbs heat from the engine. The warmed coolant is then pumped to the radiator where heat from the warmed coolant is transferred to airflow passing through the radiator.

The airflow typically enters the vehicle through a grill or other suitable openings at a front of the vehicle, which may negatively affect aerodynamic performance of the vehicle, such as heavy duty vehicles and trucks with a substantially vertical grill. To increase aerodynamic efficiency, it may be desirable to provide heavy duty vehicles and trucks with a more rounded and aerodynamic shape, and in some applications eliminate the grill altogether.

With some aerodynamic shapes, it may be desirable to provide the vehicle with a rounded front end that is closed, and does not include, or is substantially free of, air inlets. It may also be desirable to position the heat exchanger between the engine and a side of the vehicle, or behind the engine. If the radiator is positioned where airflow cannot reach the heat exchanger, and/or if no openings are included, little or no airflow will be directed through the radiator, thereby making it difficult to cool the warmed coolant passing through the heat exchanger. A cooling system that is able to cool the radiator in applications where airflow openings are not provided at a front end of the vehicle and/or in applications where the heat exchanger is positioned away from openings would be desirable.

SUMMARY

This section provides a general summary of the disclosure, and is not a comprehensive disclosure of its full scope or all of its features.

The present teachings provide for a cooling system including a heat exchanger, an airflow containment unit, and an airflow conduit. The airflow containment unit is configured to house the heat exchanger and to direct airflow to and from the heat exchanger. The airflow conduit is in fluid communication with the airflow containment unit and is configured to direct airflow to the airflow containment unit from an air inlet. The air inlet is configured to receive airflow from an atmosphere proximate to the cooling system.

The present teachings further provide for a cooling system including a heat exchanger, an airflow containment unit, a first airflow conduit, an airflow outlet conduit, and a blower. The airflow containment unit is configured to house the heat exchanger. The first airflow conduit is in fluid communication with the airflow containment unit and is configured to deliver airflow to the airflow containment unit from a first air inlet configured to receive airflow from an atmosphere proximate to the cooling system. The airflow outlet conduit directs airflow away from the airflow containment unit. The blower is configured to draw air into the first airflow conduit through the first air inlet and generate airflow through the first airflow conduit to the airflow containment unit. The blower is arranged in one of before the heat exchanger to push air across the heat exchanger, and after the heat exchanger to pull air across the heat exchanger.

The present teachings also provide for a cooling system including a radiator, an airflow containment unit housing the radiator, an airflow conduit, an airflow outlet conduit, a blower, and an energy recovery device. The airflow conduit is in fluid communication with the radiator and is configured to deliver airflow to the radiator from an air inlet configured to receive airflow from an atmosphere proximate to the cooling system. The airflow outlet conduit directs airflow away from the airflow containment unit. The blower is configured to draw air into the airflow conduit through the air inlet and generate airflow through the airflow conduit to the airflow containment unit and the radiator. The energy recovery device is configured to generate energy based on airflow that has passed through the radiator. The blower is arranged in one of before the heat exchanger to push air across the heat exchanger, and after the heat exchanger to pull air across the heat exchanger.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
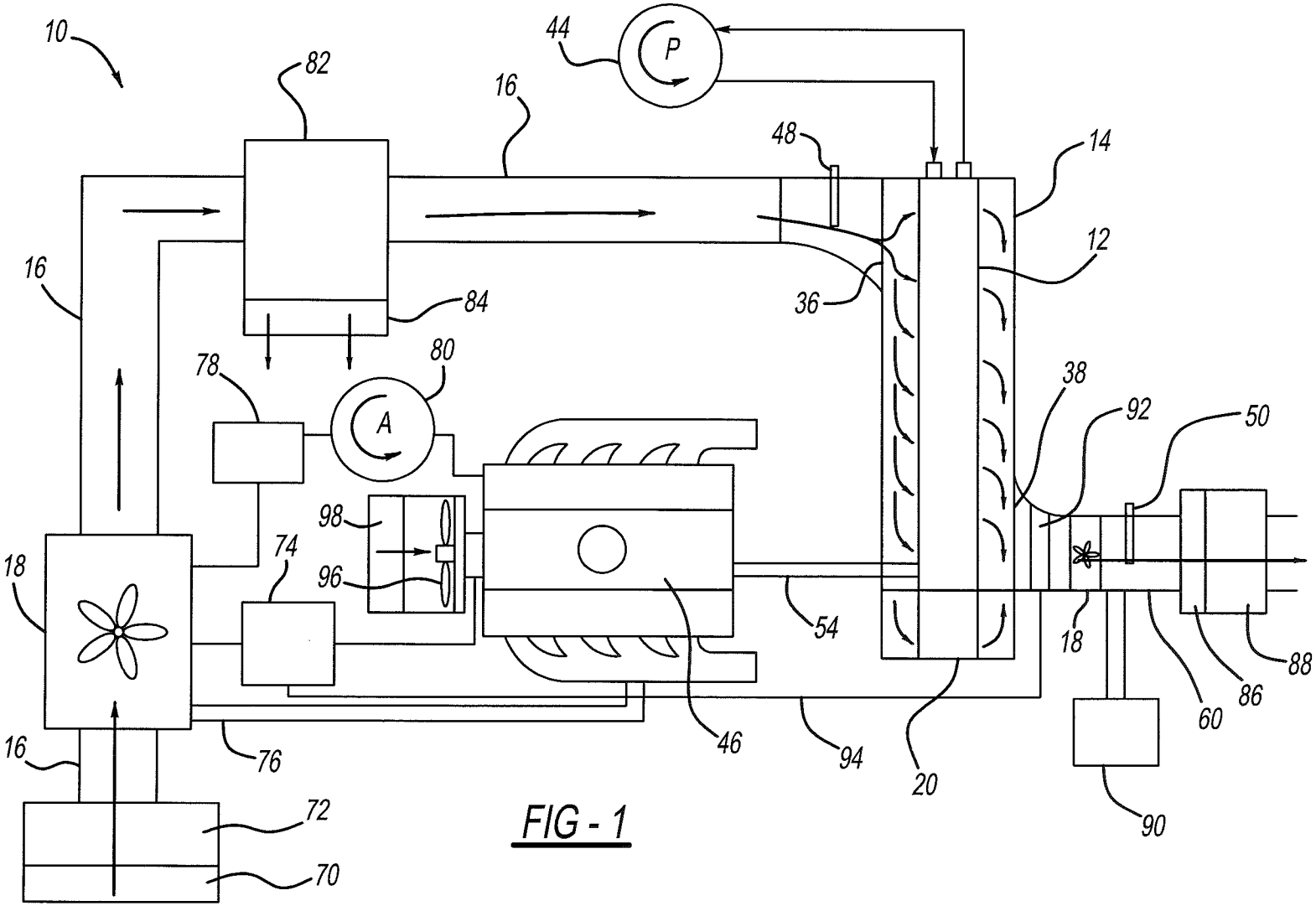
FIG. 1 is a schematic view of a cooling system according to the present teachings.

With initial reference to FIG. 1, a cooling system according to the present teachings is generally illustrated at reference numeral 10. The cooling system 10 generally includes a primary heat exchanger 12 within an airflow containment unit 14, an airflow inlet conduit 16, and a blower 18. The cooling system 10 can also include an optional secondary heat exchanger 20.

The primary heat exchanger 12 and the secondary heat exchanger 20 can each be any suitable heat exchanger, such as a radiator (illustrated in FIGS. 2 and 3, for example), an air conditioning condenser, or an oil cooler. The primary heat exchanger 12 and the secondary heat exchanger 20 can be arranged and configured relative to one another in any suitable manner, such as in series or in parallel within the airflow containment unit 14. The distance between the heat exchangers 12, and 20 and between the heat exchangers 12, or 20 and the walls of the airflow containment unit 14 can be any suitable distance to allow direction of the airflow. Airflow is directed to the primary and secondary heat exchangers 12 and 20 in any suitable manner, such as through airflow inlet conduit 16. The airflow inlet conduit 16 can be any suitable conduit, vent, or passageway suitable to convey and direct airflow to the primary heat exchanger 12 and/or the secondary heat exchanger 20. By locating multiple heat exchangers within the airflow containment unit 14, the cooling system 10 improves assembly by allowing for modular assembly, such that multiple heat exchangers can be installed as a single unit.

Figure 2:
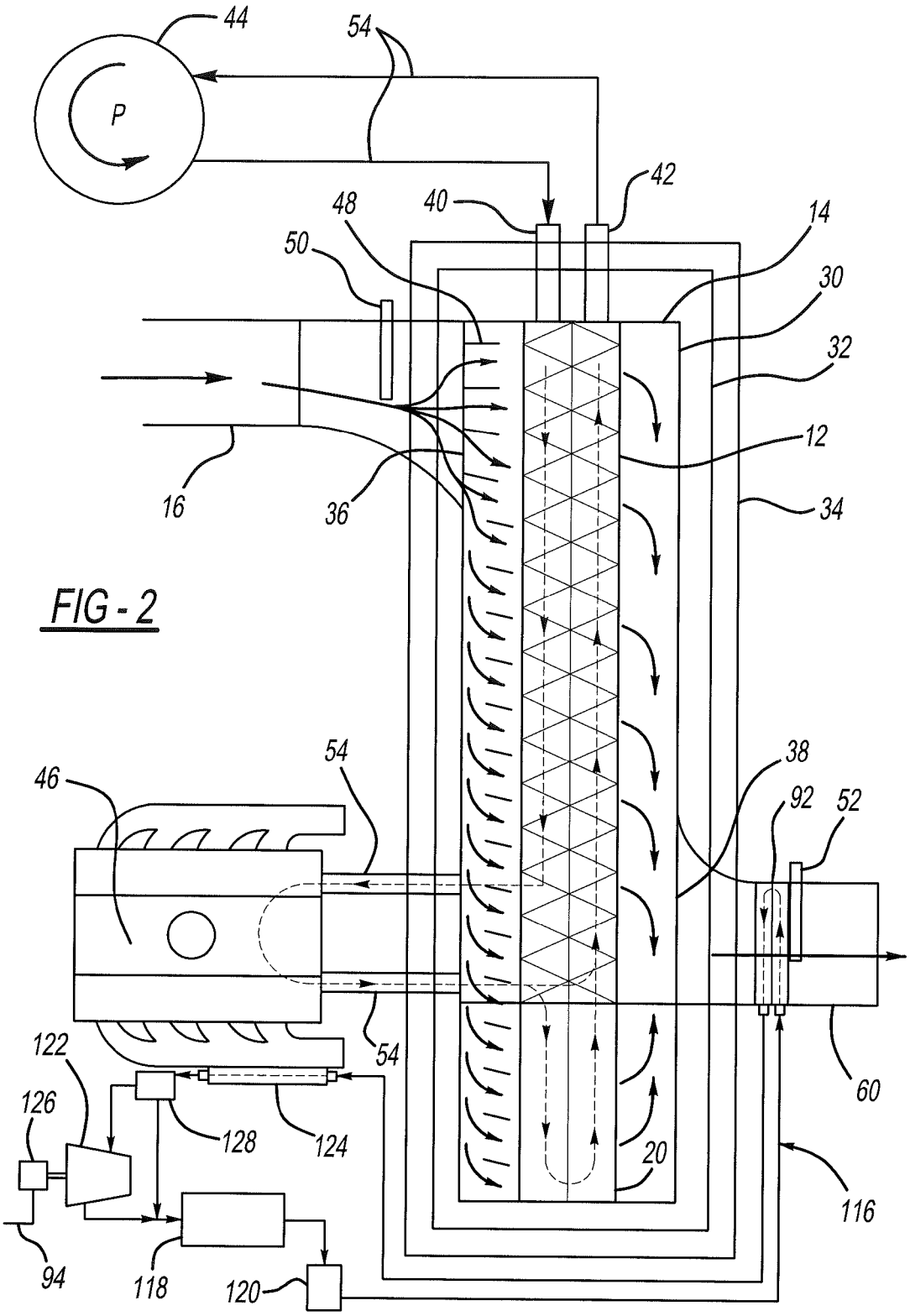
FIG. 2 is a schematic view of an airflow containment unit according to the present teachings.

With reference to FIG. 2, the airflow containment unit 14 includes a casing 30, in which the primary heat exchanger 12 is housed. The casing 30 is spaced apart from opposite sides of the primary heat exchanger 12 to define conduits on opposite sides of the primary heat exchanger 12 that facilitate passage of airflow through the primary heat exchanger 12. Surrounding the casing 30 is an intermediate protective layer 32 and an outer protective layer 34. The intermediate protective layer 32 surrounds the casing 30 and the outer protective layer 34 surrounds the intermediate protective layer 32.

The intermediate and outer protective layers 32 and 34 can be made of any suitable protective material. For example, the intermediate and outer protective layers 32 and 34 can be made of any suitable armor, ballistic, or bulletproof material to protect the primary heat exchanger 12 therein from damage, and are particularly suitable for military applications. The intermediate protective layer 32 and the outer protective layer 34 can be made of the same material or of different materials.

Figure 3:
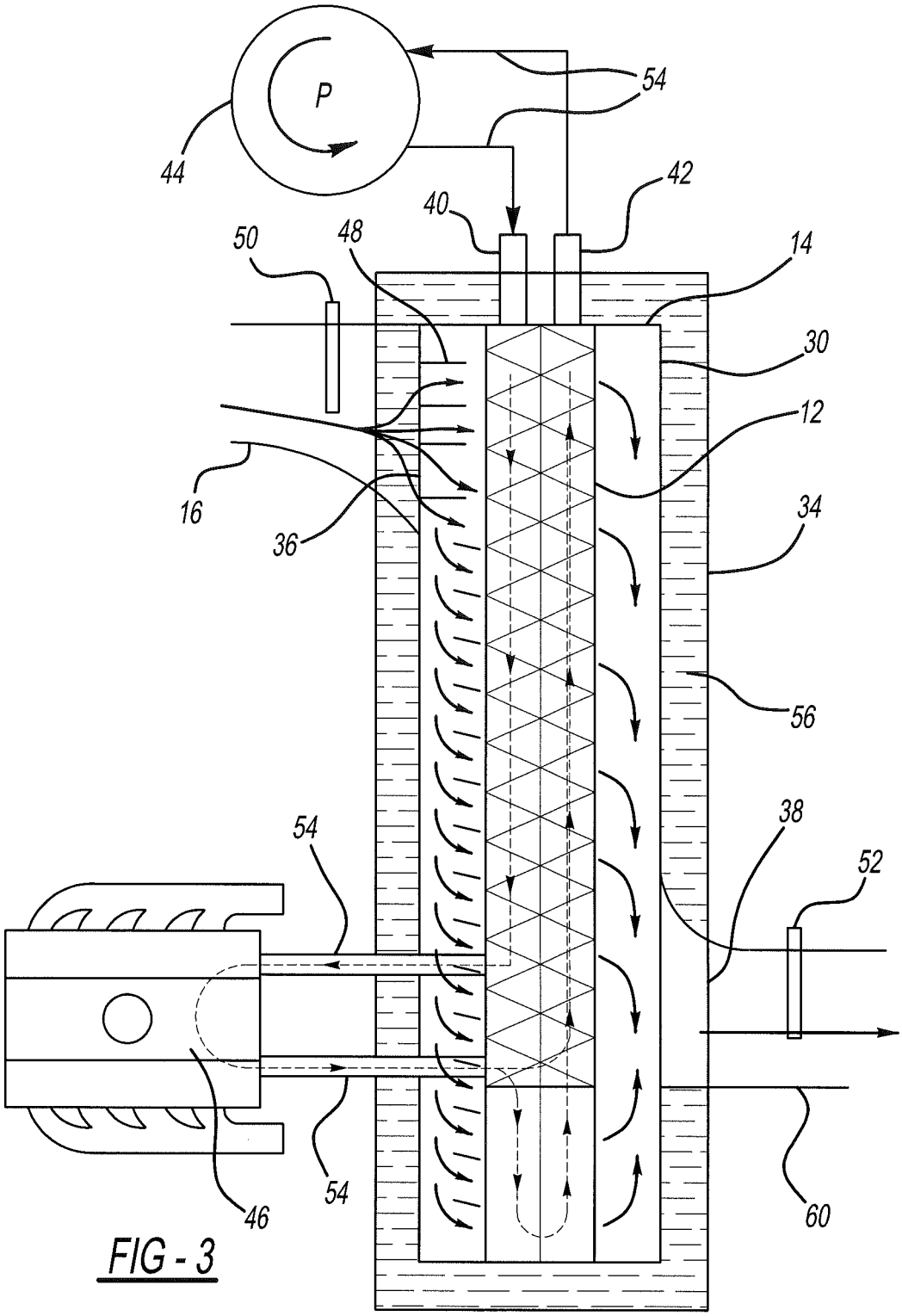
FIG. 3 is a schematic view of the airflow containment unit surrounded by a protective layer of liquid.

FIGS. 2 and 3 illustrate the primary heat exchanger 12 as being seated within the casing 30. The secondary heat exchanger 20 may be seated within the casing 30 as well, and may be protected by the intermediate and outer protective layers 32 and 34. The secondary heat exchanger 20 may also be separate from the casing 30.

The airflow containment unit 14 includes or defines an inlet 36 on an airflow inlet side of the airflow containment unit 14, and an outlet 38 on an airflow outlet side of the airflow containment unit 14. Airflow enters the airflow containment unit 14 at an inlet 36 of the airflow containment unit 14, and exits the airflow containment unit 14 at the outlet 38. The inlet 36 and outlet 38 can each also extend through the intermediate protective layer 32 and the outer protective layer 34. An airflow outlet conduit 60 is at the outlet 38 of the airflow containment unit 14 to direct airflow away from the airflow containment unit 14, as described in further detail herein. While the inlet 36 in FIGS. 1-3 is illustrated near one end of the airflow containment unit 14 and the outlet 38 is illustrated at another end of the airflow containment unit 14, it is understood that the inlet 36 and outlet 38 can be located at any point along their respective sides of the heat exchanger 12, such as near the middle of the airflow containment unit 14 for example. The inlet 36 and outlet 38 can also gradually increase or decrease to encompass the entire length of the airflow containment unit 14 similar to FIG. 4. The gradual transition from the airflow inlet conduit 16 to the inlet 36 can ensure a more laminar airflow across the heat exchanger 12, leading to better efficiency of the cooling system 10.

With continued reference to FIGS. 2 and 3, the airflow containment unit 14 further includes a pump line inlet 40 and a pump line outlet 42, each of which are in fluid communication with coolant pump 44. The pump line inlet 40 and the pump line outlet 42 can each extend through the intermediate and the outer protective layers 32 and 34. The coolant pump 44 pumps coolant to engine 46 through the primary heat exchanger 12, which is illustrated as a radiator in FIGS. 2 and 3. While the coolant pump 44 is described as pumping coolant, it is understood that other fluids can be used to transfer heat from the engine, such as oil for example. The airflow containment unit 14 can include baffling 48 to facilitate even distribution of airflow therethrough. The baffling 48 can be located at inlet 36 or along the length of the airflow containment unit 14 to direct airflow to the heat exchanger 12 and can be configured to maximize laminar flow across the heat exchanger 12. The baffling 48 can be any suitable device configured to facilitate airflow to the primary heat exchanger 12, such as channels and/or fins. The heat exchanger 12 can also include a series of channels or fins to direct airflow through the heat exchanger 12.

To facilitate operation of the primary heat exchanger 12 and monitor the effectiveness thereof, an inlet temperature sensor 50 can be included at or proximate to the inlet 36, and an outlet temperature sensor 52 can be included at the outlet 38. The inlet and outlet temperature sensors 50 and 52 can be any suitable sensor or device configured to measure temperature of airflow at or proximate to the inlet 36. Coolant is circulated through the engine 46 and at least the primary heat exchanger 12 through coolant loop 54. The secondary heat exchanger 20 can be incorporated into coolant loop 54, or fluid can be circulated in a secondary coolant loop (not shown). The secondary coolant loop can be circulated by the coolant pump 44, or a secondary coolant pump (not shown).

With reference to FIG. 3, the intermediate protective layer 32 can be removed to define a liquid tight space between the airflow containment unit 14 and the outer protective layer 34, which can be filled with any suitable protective liquid, such as water, to provide a liquid protective layer 56. The liquid protective layer 56 is particularly suitable for military applications because the liquid protective layer 56 can protect the primary heat exchanger 12 and/or the secondary heat exchanger 20 therein from damage, such as in a combat environment. The inlet 36 and the outlet 38 can each define a passageway for airflow through the liquid protective layer 56.

With renewed reference to FIG. 1, the airflow inlet conduit 16 extends from an air inlet 70 in order to direct airflow from the air inlet 70 to the airflow containment unit 14. The air inlet 70 can be provided at any suitable location, such as at an undersurface of a vehicle (such as undersurface 232 of vehicle 210 described herein), at any other suitable location on a vehicle, or at any other suitable location where the air inlet 70 is exposed to air, such as air external to the cooling system 10, in order to direct air to the airflow containment unit 14 to cool coolant passing through the primary and/or secondary heat exchangers 12 and 20. It is also contemplated that the cooling system 10 can be incorporated in a stationary or mobile device besides a vehicle, such as a generator, or earthmoving equipment, for example. A filter 72 can be included at any suitable location, such as proximate to the air inlet 70, in order to filter airflow passing through the air inlet 70. The filter 72 can be any suitable type of air filter configured to block undesirable materials from passing into the airflow inlet conduit 16, such as dirt, debris, and/or any other foreign objects.

The blower 18 can be any suitable device operable to draw airflow into the airflow inlet conduit 16 from the air inlet 70 and to the airflow containment unit 14. For example, the blower 18 can be a fan, which can be operated in both a forward and a reverse direction. In the forward direction, the fan can be configured to draw airflow in through the air inlet 70. In the reverse direction, the fan can be configured to push airflow out through the filter 72 and through the air inlet 70, such as to clear the airflow inlet conduit 16 and/or the filter 72 of undesirable materials, such as dirt, debris, ice, snow, mud, gravel, water, or any other foreign objects. By using the blower 18 to direct air through the airflow containment unit 14, the size of the primary and/or secondary heat exchangers 12 and/or 20, can be reduced, leading to improved efficiency and reduced weight. This directed airflow also reduces deadspots commonly seen in current cooling systems caused by traditional vehicle grills that block airflow to parts of the heat exchanger. Instead, the directed airflow allows the airflow to pass over the entire heat exchanger surface. Additionally, while traditional cooling systems require the heat exchanger to be located where air can naturally flow across the heat exchanger, such as in the front of the vehicle for example, the blower 18 allows the airflow containment unit 14 to be located in nearly any orientation relative to the vehicle. For example, the airflow containment unit 14 can be located behind, or beside the engine. Furthermore the protective qualities of the air containment unit 14 can allow for thinner materials and denser fins to be used in the heat exchangers 12, and/or 20, also leading to increased efficiency and reduced weight. The blower motor 74 can be powered by the engine 46, or any other suitable power source. An engine conduit 76 can be provided between the blower 18 and the engine 46 to direct airflow from the air inlet 70 to the engine 46, and thus cool the engine 46. Power electronics 78, such as a battery, can also be included to power the blower 18. The electronics 78 can be powered by an alternator 80, which can be coupled to the engine 46.

The blower 18 can be located at any point along the airflow inlet conduit 16 in order to blow air through the airflow containment unit 14, or can be located at any point along outlet conduit 60 to draw air through the airflow containment unit 14. It is also understood that multiple blowers 18 may be used and located in either the airflow inlet conduit 16, or outlet conduit 60. For example, multiple blowers may be used on the airflow inlet conduit 16, or the outlet conduit 60 to draw air from one or more air inlets 70, or to blow air out of one or more outlets 88. Alternatively, one or more blowers 18 may be located in the airflow inlet conduit 16 to draw air in, while one or more second blowers 18 is located in the outlet conduit 60 to exhaust air out. It is understood that the configuration of the blowers can be adjusted due to the requirements of the application. For example, multiple smaller blowers 18 can deliver a moderate flow rate more efficiently for applications with moderate average flow requirements and less demanding duty cycles, while one large blower 18 can deliver a high flow rate more efficiently for applications with high average flow requirements or demanding duty cycles. Likewise, using one puller blower 18 on the inlet side and one pusher blower 18 on the outlet side can aid in extracting heated air at a faster rate for vehicles that operate in high heat conditions.

To further clear debris and any other unwanted materials from the airflow inlet conduit 16, a debris separator 82 can be included along the airflow inlet conduit 16 between the blower 18 and the airflow containment unit 14. The debris separator 82 can be any suitable debris separation device, such as a filter, to remove debris from within the airflow inlet conduit 16 through outlet 84. From the debris separator 82, the airflow inlet conduit 16 extends to the airflow containment unit 14.

At the airflow containment unit 14, airflow is directed through the primary heat exchanger 12, and/or the secondary heat exchanger 20, to cool coolant passing through the coolant loop 54, for example. The exact airflow path and the exact structure of the primary and secondary heat exchangers 12 and 20 will vary based on the particular heat exchanger. For example, and with respect to the radiator, cool airflow will pass through the inlet 36 of the airflow containment unit 14 and through the primary and/or secondary heat exchangers 12 and 20. Optional baffling 48 will facilitate airflow through the primary and/or secondary heat exchangers 12 and 20 in order to adequately cool coolant passing through the coolant loop 54 and through the primary and/or secondary heat exchangers 12 and 20.

When the coolant is warm, such as warmer than the airflow, the airflow exiting the primary and/or secondary heat exchangers 12 and 20 will be warmer after having passed therethrough. Upon exiting the airflow containment unit 14 through the outlet 38, the warmed airflow is directed to outlet conduit 60 and ultimately outlet 88. From outlet 88, the airflow can be directed to an external atmosphere, such as an atmosphere external to a vehicle including the cooling system 10, or can be reused in any suitable manner. For example, the warmed airflow can be directed to a vehicle cabin (such as cabin 226 of vehicle 210 described herein) in order to warm the cabin. Other uses for the warmed air include, but are not limited to, deicing a vehicle windshield (such as windshield 228 of vehicle 210 described herein). Prior to the warmed airflow being reused, the airflow may be filtered, such as by filter/purifier 86 between the outlet 88 and the outlet 38 of the airflow containment unit 14.

Figure 5:
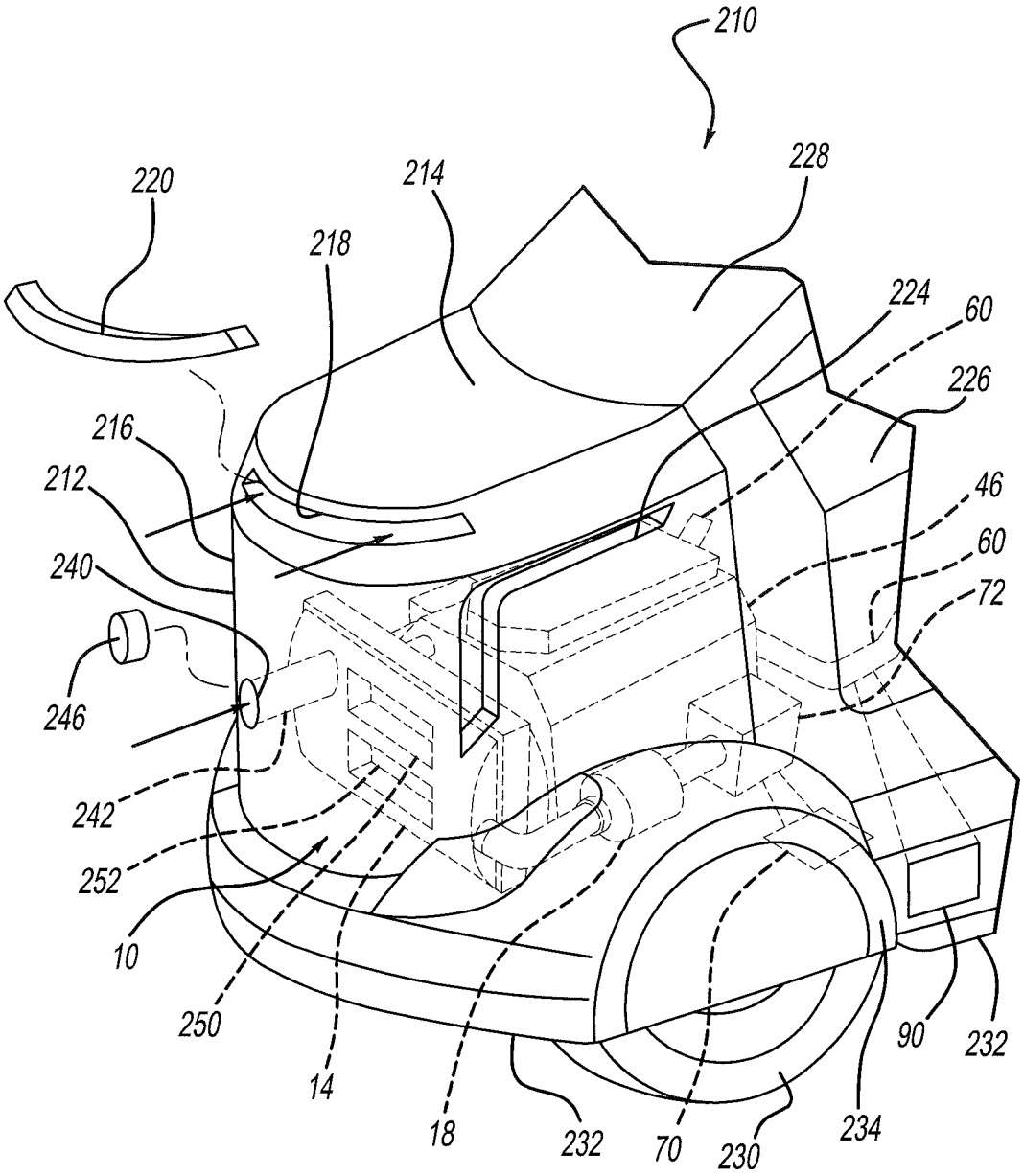
FIG. 5 is a perspective view of a front end of a vehicle including the cooling system according to the present teachings.

To facilitate drawing airflow in through the air inlet 70, through the airflow inlet conduit 16, and through the airflow containment unit 14, the cooling system 10 can further include a port 90 between the outlet 88 and the airflow containment unit 14. The port 90 can be any suitable opening to atmosphere surrounding the cooling system 10, such as the atmosphere external to a vehicle including the cooling system 10. The port 90 is configured to provide a negative vacuum to pull air out of the outlet airflow containment unit 14 and draw airflow in through the air inlet 70 and to the outlet 88. The port 90 can be any suitable device, configuration, arrangement, or structure configured to create the vacuum, such as by using aerodynamic drag resulting from movement of the vehicle. The port 90 can be in any suitable location, such as behind a vehicle fender, as illustrated in FIG. 5 with respect to vehicle 210 for example.

Airflow passing through the outlet conduit 60 can also be used for energy recovery. For example, the airflow can pass through a suitable energy recovery device 92 between the airflow containment unit 14 and the outlet 88. The energy recovery device 92 can be any suitable device configured to generate energy from passage of airflow through the outlet conduit 60, such as a rotatable turbine or fan. The energy recovery device 92 can be coupled to the blower motor 74, for example, to power the blower motor 74 and the blower 18. The energy recovery device 92 can be coupled to the blower motor 74 in any suitable manner, such as physically coupled to the shaft of the motor, or electrically coupled with line 94, which can be a conductor line to provide electrical energy to the blower motor 74. Alternatively, the energy recovery device 92 can be coupled to an energy storage device (not shown), such as a vehicle battery for example, to recover the energy for later use.

As illustrated in FIG. 2, the energy recovery device 92 can alternatively be a first recovery heat exchanger coupled to a recovery circuit 116. The recovery circuit 116 include a condensation tank 118, a pump 120, an expansion turbine 122, and can optionally include a second recovery heat exchanger 124, all coupled for fluid communication. The recovery circuit 116 can be configured to cycle a fluid, such as a refrigerant or mixture of water and ammonia for example. The condensation tank 118 can allow the fluid to condense to a liquid state. The pump can pump the fluid from the condensation tank 118 into the energy recovery device 92. The energy recovery device 92 can be located within the airflow containment unit 14 after the heat exchanger 12, or within the airflow outlet conduit 60, such that some of the heat gained by the air flowing through the cooling system can be transferred to the fluid within the recovery circuit 116. The fluid within the recovery circuit 116 can then flow into the second recovery heat exchanger 124. The second recovery heat exchanger 124 can allow heat to be transferred from the engine exhaust to the recovery circuit 116. This additional heat can improve the efficiency of the recovery system. The fluid can flow from the energy recovery device 92, or from the second recovery heat exchanger 124, to a separator 128. The separator 128 can separate the liquid phase of the fluid from the hot gas phase and direct the liquid to the condensation tank 118 and the gas to the expansion turbine 122. The expansion turbine 122 can convert the heat energy of the fluid into a useable form. In the example, the expansion turbine 122 can allow the fluid to expand therein and convert the heat energy to rotational energy. The rotational energy can then be used directly to assist the operation of the blower 18, or can be converted to electrical energy by a conversion device 126. The energy recovery device 92 can be coupled to the blower motor 74, for example, to power the blower motor 74 and the blower 18. The energy recovery device 92 can be coupled to the blower motor 74 in any suitable manner, such as physically coupled to the shaft of the motor, or electrically coupled with line 94, which can be a conductor line to provide electrical energy to the blower motor 74. Alternatively, the energy recovery device 92 can be coupled to an energy storage device (not shown), such as a vehicle battery for example, to recover the energy for later use.

The cooling system 10 can further include an engine airflow inlet 98. The inlet 98 can be provided at any suitable location to direct airflow to the engine 46, such as from outside a vehicle that the cooling system 10 is included with. The cooling system 10 can further include an engine fan 96, which can be driven by the engine 46. The engine fan 96 can be configured to direct airflow entering through the inlet 98 to the engine 46 in order to cool the engine 46.

Figure 4:
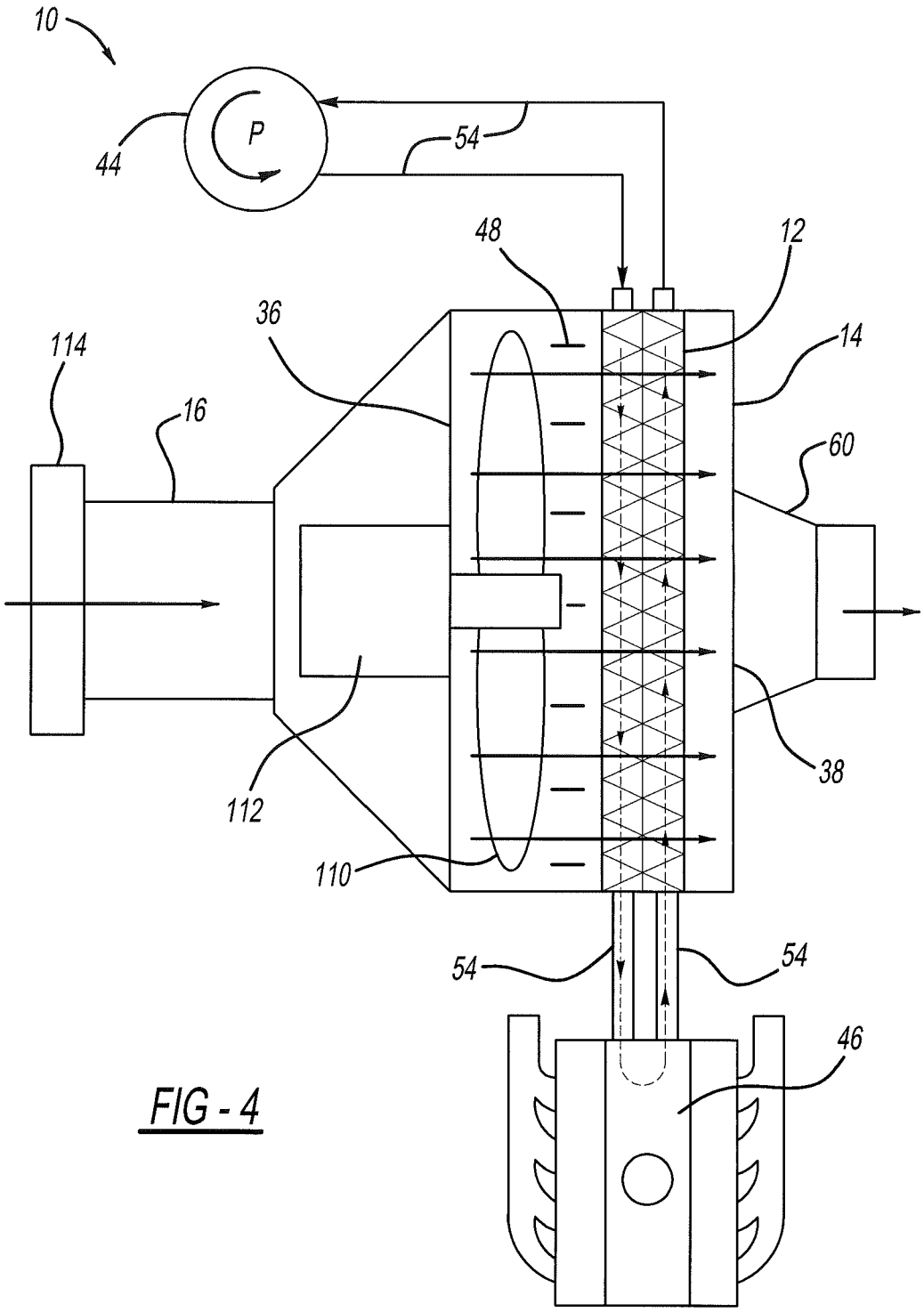
FIG. 4 is a schematic view of another airflow containment unit according to the present teachings.

With additional reference to FIG. 4, the airflow containment unit 14 can include a blower 110 therein. The blower 110 can be any suitable device configured to create and direct airflow through the primary and/or secondary heat exchangers 12 and 20, such as a fan powered by fan motor 112. Because the blower 110 is within the airflow containment unit 14 and in-line with the airflow inlet conduit 16, the blower 110 can further facilitate production and direction of airflow through the airflow containment unit 14. To further restrict passage of undesirable materials through the airflow containment unit 14, a filter 114 can be included in the airflow inlet conduit 16 proximate to the fan motor 112. The filter 114 can be any suitable filter configured to restrict passage of unwanted materials therethrough, such as, for example, dirt, debris, snow, ice, mud, etc.

An exemplary vehicle 210 suitable for including the cooling system 10 therein is illustrated in FIG. 5. The vehicle 210 includes a front end 212, which is opposite to a rear end (not shown). At the front end 212 is a hood or upper portion 214 of the front end 212. The hood 214 covers engine enclosure 216, which includes therein at least the following portions of the cooling system 10: the blower 18, the filter 72, the airflow inlet conduit 16, and the airflow containment unit 14. The engine 46 is also included in the engine enclosure 216.

At the front end 212 is defined a slit inlet 218. The slit inlet 218 provides an opening for airflow to pass therethrough and into the engine enclosure 216. The airflow can pass or be directed to the airflow containment unit 14 to cool the primary and/or secondary heat exchangers 12 and 20. The slit inlet 218 can also be configured to direct airflow to the engine 46 in order to cool the engine 46. The slit inlet 218 can be opened or closed by inserting slit cover 220 therein. One or more side slits 224 can be defined at the front end 212 and can be configured to further direct airflow to cool the engine 46, as well as the primary and/or secondary heat exchangers 12 and 20.

The vehicle 210 further includes a cabin 226 and a windshield 228. As explained above, warmed airflow exiting the outlet 88 can be directed to the cabin 226 in order to warm the cabin 226. The warmed airflow can also be directed to the windshield 228 in order to defrost the windshield 228, for example.

The vehicle 210 can further include a plurality of wheels 230 extending beyond an undersurface or bottom 232 of the vehicle 210. As explained above, the air inlet 70 can be provided at the undersurface or bottom 232 in order to receive air at the undersurface 232 and direct air to the airflow containment unit 14 and/or the engine 46, for example. Locating the air inlet 70 at the undersurface 232, rather than at the front end 212 for example, can enhance the aerodynamics of the front end 212. FIG. 5 illustrates the port 90 rearward of the wheel 230, such as behind a fender 234 associated therewith. The port 90 can be located at any other suitable location on the vehicle 210 in order to create a vacuum to draw airflow in through the air inlet 70 and through the airflow inlet conduit 16 due to aerodynamics of the vehicle 210, for example.

The vehicle 210 further includes a front auxiliary air inlet 240 at the front end 212 of the vehicle 210. Extending from the front auxiliary air inlet 240 to the airflow containment unit 14 is a front auxiliary airflow conduit 242. The front auxiliary airflow conduit 242 can be covered with a cap 246. When not covered by the cap 246, the front auxiliary airflow conduit 242 is configured to direct airflow to the airflow containment unit 14 from proximate to the front end 212 of the vehicle 210 in order to cool coolant passing through the primary and/or secondary heat exchangers 12 and 20. Because the front auxiliary air inlet 240 is at the front end 212 of the vehicle 210, as the vehicle 210 travels forward airflow will flow into the front auxiliary airflow conduit 242 without having to be drawn therein, such as with the blower 18. Therefore, if the blower 18 is not operating optimally, and/or the air inlet 70 becomes clogged, the cap 246 can be removed to allow the coolant to be cooled, and allow the engine 46 to continue to operate until any issues with the blower 18 or the air inlet 70, for example, can be resolved. Similarly, the slit cover 220 can be removed from within the slit inlet 218 to allow airflow to pass therethrough to further cool the coolant and/or the engine 46.

The airflow containment unit 14 can include a front slit 250 and/or a rear slit 252 on opposite sides of the airflow containment unit 14. When the rear slit 252 faces the engine 46, as illustrated in FIG. 5, airflow passing through the airflow containment unit 14 can exit through the rear slit 252 and flow to the engine 46 in order to cool the engine 46. Airflow through the airflow containment unit 14 can be enhanced when the front slit 250 is included. For example, airflow passing through the slit inlet 218 or any other opening, or from any other source, can be directed to flow through the front slit 250 into the primary and/or secondary heat exchangers 12 and 20 in order to cool coolant passing therethrough.

Figure 6A:
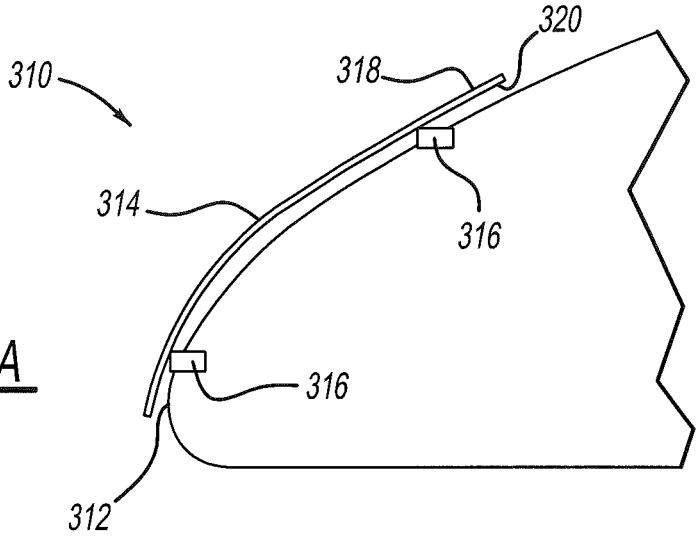
FIG. 6A is a schematic view of another vehicle with a grill according to the present teachings mounted thereto.
Figure 6B:
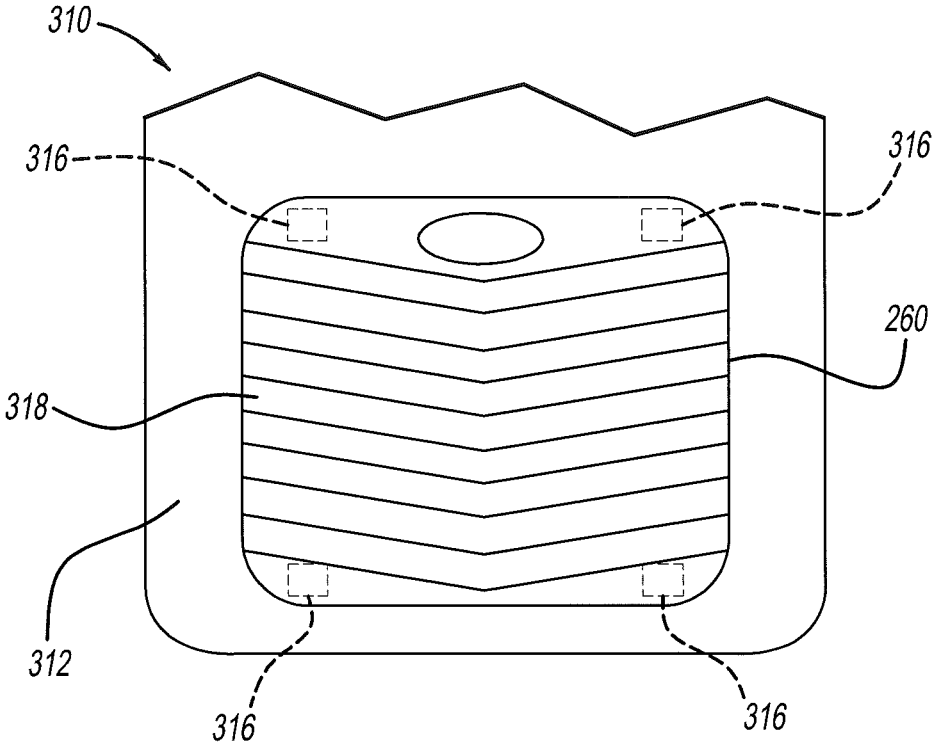
FIG. 6B is a schematic front view of the vehicle of FIG. 6A with the grill mounted thereto.

With additional reference to FIGS. 6A and 6B, a schematic view of a front end 312 of another vehicle 310 according to the present teachings is illustrated. A grill 314 is mounted to the front end 312 with brackets 316. The brackets 316 can be any suitable mounting device or feature configured to secure the grill 314 to the front end 312. The grill 314 includes an outer surface 318 and an inner surface 320, which is opposite to the outer surface 318. The grill 314 can be mounted such that the inner surface 320 is spaced apart from the front end 312. The inner surface 320 can also be in contact with the front end 312.

The grill 314 can be any suitable covering for the front end 312 such as a decorative covering resembling a grill with openings for air to pass therethrough. However, the grill 314 need not include such openings, and thus the outer and inner surfaces 318 and 320 can be generally solid surfaces throughout. With respect to the outer surface 318, for example, the outer surface 318 can be solid and configured to direct airflow around the grill 314 and around the front end 312 of the vehicle 310 in order to enhance the aerodynamics of the vehicle 310. The grill 314 can also be configured to be mounted to the front end 312 of the vehicle 210, such as with the brackets 316 or any other suitable bracket or mounting device. The grill 314 can enhance the aesthetics of the vehicle 310 or 210, or any suitable vehicle. For example, the grill 314 can make it appear as though the vehicle 210 or the vehicle 310 includes a grill that allows passage of airflow therethrough and to a heat exchanger, which may be visually attractive.

Figure 7:
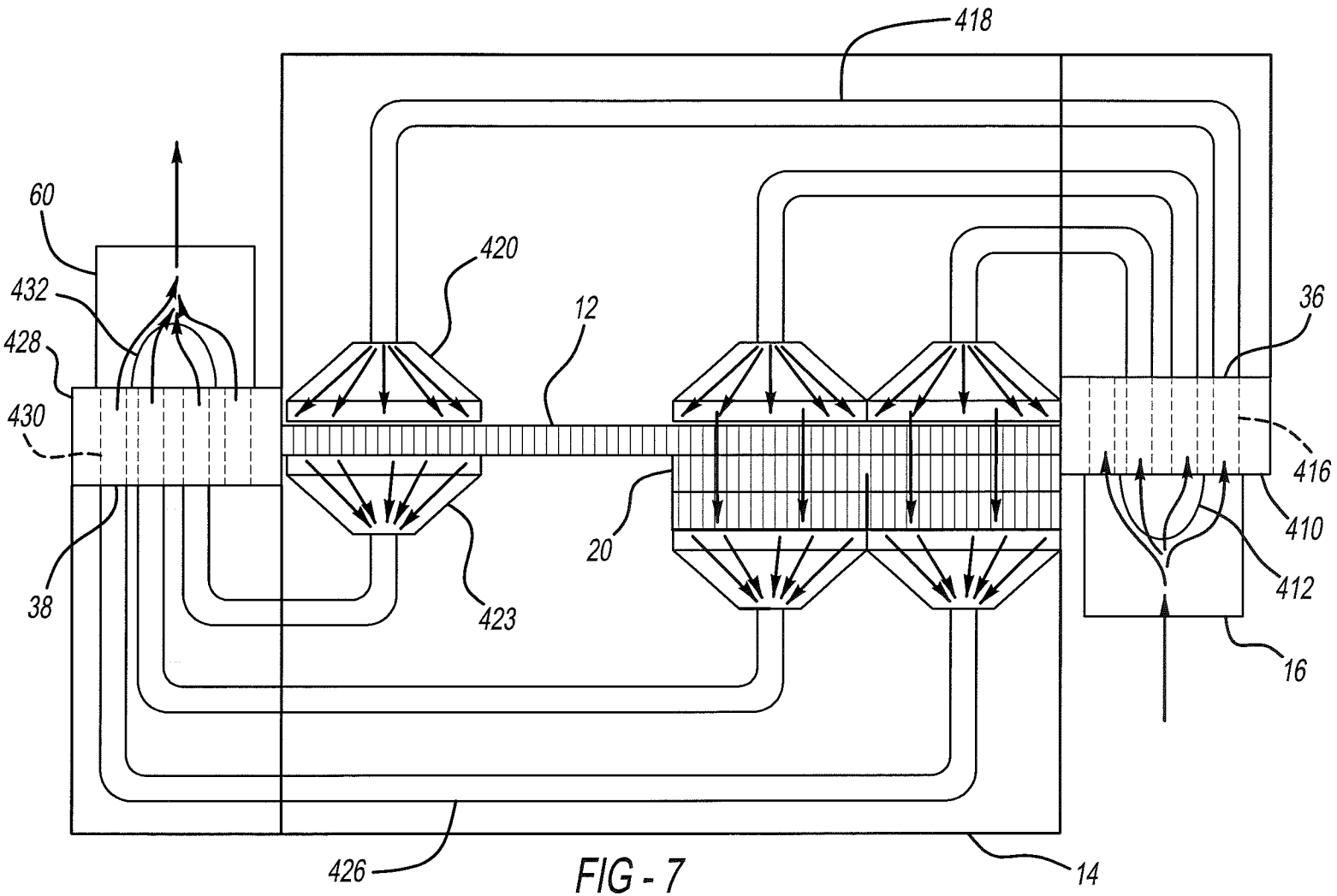
FIG. 7 is a top view of an air distribution device that can be used within the airflow containment unit of the present teachings.
Figure 8:
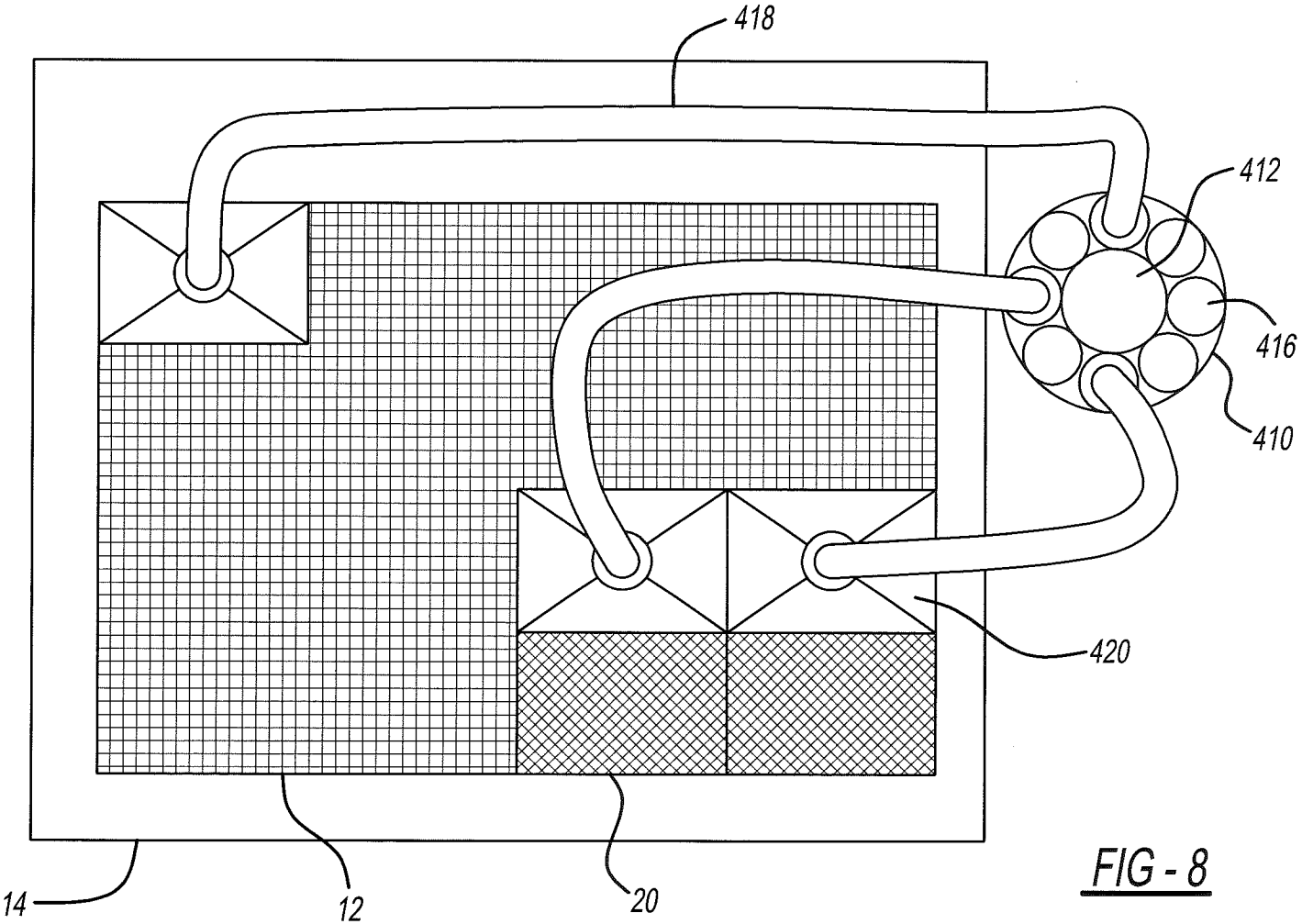
FIG. 8 is a front view of the air distribution device of FIG. 7.

With reference to FIGS. 7 and 8, an airflow distribution device 410 can be located inline with the airflow inlet conduit 16, proximal to the inlet 36 of the airflow containment unit 14. The airflow distribution device 410 can include a diverter body 412 and a plurality of distribution conduits 416. The diverter body 412 can be any suitable shape to divert airflow from the airflow inlet conduit 16 to each distribution conduit 416, such as a parabolic, or ovoid shape for example, to minimize turbulence of the airflow during diversion. Each distribution conduit 416 can be coupled to a distribution tube 418 to direct airflow to a specific location on the primary heat exchanger 12. This allows for more airflow to be directed to areas where greater airflow is desired, such as where the secondary heat exchanger 20 is stacked in series with the primary heat exchanger 12. The distribution tubes 418 can be any suitable material, such as convoluted tubes with smooth inner walls for example. The distribution tubes 418 can be coupled to distribution cones 420. The distribution cones 420 can spread the airflow across a portion of the heat exchanger 12, or 20. Collection cones 422 can be located on the opposite side of the heat exchangers 12, or 20 from the distribution cones 420 and be configured to funnel airflow from a portion of the heat exchanger 12, or 20, to an outlet tube 424. Each outlet tube 426 can then be routed from the air containment unit 14, to a convergence device 428. The convergence device 428 can be substantially similar to the distribution device 410 in reverse. The convergence device 428 can include a plurality of convergence conduits 430 coupled to the outlet tubes 424 and a convergence body 432. The convergence body 432 can be any suitable shape to converge airflow from each convergence conduit 430 to the airflow outlet conduit 60, such as a parabolic, or ovoid shape for example, to minimize turbulence of the airflow during convergence. It should be appreciated that the locations and number of the distribution and collection cones 420, 422 on the heat exchangers 12, 20 are shown for exemplary purposes and can be located as needed by the specific application.

Additionally, the distribution cones 420 can be coupled together, or molded in a single piece such that a single unit can be mounted to the heat exchangers 12, 20, allowing the distribution tubes 418 to be attached as needed. Similarly, the collection cones 422 can be formed or coupled in the same way.

Figure 9:
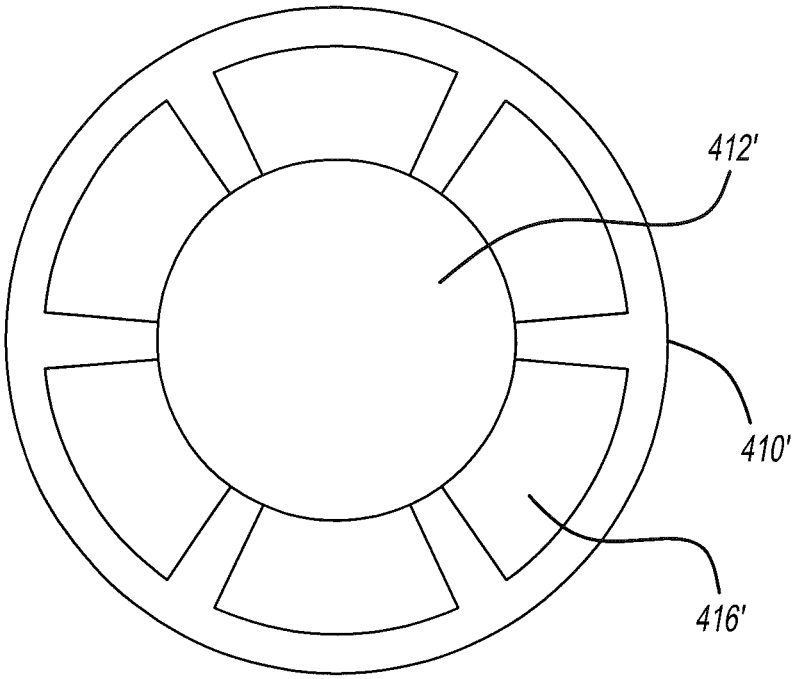
FIG. 9 is a front view of an alternative configuration for the air distribution device.

FIG. 9 illustrates an alternative configuration of the airflow distribution device 410' and the convergence device 428'. The airflow distribution device 410' and convergence device 428' are substantially the same as their counterparts 410 and 428, with the exception that the distribution conduits 416', and the convergence conduits 430' are wedge shaped to minimize losses and turbulence. Likewise, the distribution tubes 418 and the outlet tubes 426 can be similarly shaped, or the distribution and convergence conduits 416', 430' can be configured to couple to a non wedge shaped tube, such as by transitioning from a wedge shape at its inlet to a round shape at its outlet for example.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cooling system located on a vehicle, the cooling system comprising:

at least one heat exchanger;

an airflow containment unit configured to house the least one heat exchanger and to direct airflow to and from the least one heat exchanger therein;

an airflow conduit in fluid communication with the airflow containment unit and configured to direct airflow to the airflow containment unit from an air inlet, the air inlet configured to receive airflow from an atmosphere proximate to the cooling system;

an airflow distribution device inline with the airflow conduit including a diverter body and a plurality of distribution conduits, the diverter body shaped to divert airflow from the airflow conduit to each one of the plurality of distribution conduits, each one of the plurality of distribution conduits coupled to a different one of a plurality of distribution tubes;

a plurality of distribution cones each arranged at a different portion of less than an entirety of the least one heat exchanger such that airflow is directed to less than the entirety of the at least one heat exchanger, each one of the plurality of distribution cones is connected to a different one of the plurality of distribution tubes and configured to spread airflow across the portion of the at least one heat exchanger that each distribution cone is arranged at;

a plurality of collection cones each arranged opposite to a different one of the plurality of distribution cones on an opposite side of the at least one heat exchanger to collect airflow from the plurality of distribution cones that has passed through the at least one heat exchanger;

a blower configured to draw air in through the air inlet, the blower is arranged one of before the least one heat exchanger to push air across the at least one heat exchanger, and after the at least one heat exchanger to pull air across the at least one heat exchanger;

an energy recovery device configured to generate energy based on airflow that has passed through the at least one heat exchanger;

an airflow outlet conduit arranged to direct airflow away from the airflow containment unit;

an air outlet fluidly coupled to the airflow outlet conduit, the air outlet is at an exterior of the vehicle rearward of the air inlet;

a plurality of outlet tubes, each of which is connected to a different one of the plurality of collection cones to direct airflow from the plurality of collection cones to a plurality of convergence conduits of a convergence device having a convergence body shaped to converge airflow from each one of the plurality of convergence conduits to the airflow outlet; and a vacuum port at an exterior of the vehicle and connected to the airflow outlet conduit between the airflow containment unit and the air outlet, the vacuum port is configured to generate a vacuum through the cooling system when the vehicle is in motion to draw airflow through the cooling system;

wherein:

the air inlet is rearward of a front end of the vehicle; and airflow entering an engine air inlet rearward of the front end of the vehicle is directed to the engine to cool the engine.

2. The cooling system of claim 1, wherein the blower is a first blower and further comprising a second blower, wherein the second blower is arranged one of before the at least one heat exchanger along the airflow conduit, and after the least one heat exchanger along the airflow outlet conduit.

3. The cooling system of claim 1, wherein the least one heat exchanger is at least one of a radiator, a condenser, or an oil cooler.

4. The cooling system of claim 1, wherein the at least one heat exchanger includes a plurality of heat exchangers arranged either in series or parallel.

5. The cooling system of claim 1, wherein the air inlet is at an undersurface of the vehicle.

6. The cooling system of claim 1, wherein the air inlet is rearward of a front wheel of the vehicle.

7. The cooling system of claim 1, further comprising an airflow outlet proximate to an outlet of the least one heat exchanger and configured to direct airflow having passed through the at least one heat exchanger to a cabin of the vehicle to heat the vehicle.

8. The cooling system of claim 1, further comprising an airflow outlet proximate to an outlet of the at least one heat exchanger configured to direct airflow having passed through the at least one heat exchanger to a windshield.

9. The cooling system of claim 1, further comprising a cover surrounding the airflow containment unit, the cover is at least one of ballistic, armored, or bulletproof.

10. The cooling system of claim 1, further comprising a liquid-tight cover surrounding the airflow containment unit configured to retain a layer of protective liquid around the airflow containment unit.

11. The cooling system of claim 1, wherein the air inlet and the engine air inlet are a single inlet.

12. The cooling system of claim 1, wherein the airflow containment unit defines an opening at a side thereof configured to face an engine of the vehicle to direct airflow having passed through the at least one heat exchanger to the engine.

13. The cooling system of claim 1, wherein the vacuum port is at a side of the vehicle.

14. A cooling system located on a vehicle, the cooling system comprising:

a heat exchanger;

an airflow containment unit configured to house the heat exchanger and to direct airflow to and from the heat exchanger therein;

an airflow conduit in fluid communication with the airflow containment unit and configured to direct airflow to the airflow containment unit from an air inlet, the air inlet configured to receive airflow from an atmosphere proximate to the cooling system;

an airflow distribution device inline with the airflow conduit including a diverter body and a plurality of distribution conduits, the diverter body shaped to divert airflow from the airflow conduit to each one of the plurality of distribution conduits, each one of the plurality of distribution conduits coupled to a different one of a plurality of distribution tubes;

a plurality of distribution cones each arranged at a different portion of less than an entirety of the heat exchanger such that airflow is directed to less than the entirety of the heat exchanger, each one of the plurality of distribution cones is connected to a different one of the plurality of distribution tubes and configured to spread airflow across the portion of the heat exchanger that each distribution cone is arranged at;

a plurality of collection cones each arranged opposite to a different one of the plurality of distribution cones on an opposite side of the heat exchanger to collect airflow from the plurality of distribution cones that has passed through the heat exchanger;

a blower configured to draw air in through the air inlet, the blower is arranged one of before the heat exchanger to push air across the heat exchanger, and after the heat exchanger to pull air across the heat exchanger;

an energy recovery device configured to generate energy based on airflow that has passed through the heat exchanger;

an airflow outlet conduit arranged to direct airflow away from the airflow containment unit;

an air outlet fluidly coupled to the airflow outlet conduit, the air outlet is at an exterior of the vehicle rearward of the air inlet;

a plurality of outlet tubes, each of which is connected to a different one of the plurality of collection cones to direct airflow from the plurality of collection cones to a plurality of convergence conduits of a convergence device having a convergence body shaped to converge airflow from each one of the plurality of convergence conduits to the airflow outlet; and a vacuum port at an exterior of the vehicle and connected to the airflow outlet conduit between the airflow containment unit and the air outlet, the vacuum port is configured to generate a vacuum through the cooling system when the vehicle is in motion to draw airflow through the cooling system;

wherein:

the air inlet is rearward of a front end of the vehicle; and airflow entering an engine air inlet rearward of the front end of the vehicle is directed to the engine to cool the engine.

15. The cooling system of claim 14, wherein the blower is within the airflow containment unit.

16. The cooling system of claim 14, further comprising a second airflow conduit in communication with the airflow containment unit and configured to deliver airflow to the airflow containment unit from a second air inlet.

17. The cooling system of claim 14, wherein the airflow containment unit defines an opening at a side thereof configured to face an engine of the vehicle to direct airflow having passed through the heat exchanger to the engine.

18. The cooling system of claim 14, wherein the first air inlet and the engine air inlet are a single inlet.

19. The cooling system of claim 14, wherein the vacuum port is at a side of the vehicle.

20. A cooling system located on a vehicle, the cooling system comprising:

a radiator;

an airflow containment unit housing the radiator;

an airflow conduit in fluid communication with the radiator and configured to deliver airflow to the radiator from an air inlet, the air inlet configured to receive airflow from an atmosphere proximate to the cooling system;

an airflow distribution device inline with the airflow conduit including a diverter body and a plurality of distribution conduits, the diverter body shaped to divert airflow from the airflow conduit to each one of the plurality of distribution conduits, each one of the plurality of distribution conduits coupled to a different one of a plurality of distribution tubes;

a plurality of distribution cones each arranged at a different portion of less than an entirety of the radiator such that airflow is directed to less than the entirety of the radiator, each one of the plurality of distribution cones is connected to a different one of the plurality of distribution tubes and configured to spread airflow across the portion of the radiator that each distribution cone is arranged at;

a plurality of collection cones each arranged opposite to a different one of the plurality of distribution cones on an opposite side of the radiator to collect airflow from the plurality of distribution cones that has passed through the radiator;

an airflow outlet conduit to direct airflow away from the airflow containment unit;

an air outlet fluidly coupled to the airflow outlet conduit, the air outlet is at an exterior of the vehicle rearward of the air inlet;

a plurality of outlet tubes, each of which is connected to a different one of the plurality of collection cones to direct airflow from the plurality of collection cones to a plurality of convergence conduits of a convergence device having a convergence body shaped to converge airflow from each one of the plurality of convergence conduits to the airflow outlet;

a blower configured to draw air into the airflow conduit through the air inlet and generate airflow through the airflow conduit to the airflow containment unit and the radiator;

an energy recovery device configured to generate energy based on airflow that has passed through the radiator; and a vacuum port at an exterior of the vehicle and connected to the airflow outlet conduit between the airflow containment unit and the airflow outlet, the vacuum port is configured to generate a vacuum through the cooling system when the vehicle is in motion to draw airflow through the cooling system;

wherein:

the blower is arranged one of before the radiator to push air across the radiator, and after the radiator to pull air across the radiator;

the air inlet is rearward of a front end of the vehicle; and airflow entering an engine air inlet rearward of the front end of the vehicle is directed to the engine to cool the engine.

21. The cooling system of claim 20, wherein the air inlet and the engine air inlet are a single inlet.

22. The cooling system of claim 20, wherein the airflow containment unit defines an opening at a side thereof configured to face an engine of the vehicle to direct airflow having passed through the radiator to the engine.

23. The cooling system of claim 20, wherein the vacuum port is at a side of the vehicle.

* * * * *